United States Patent [19]

Pitts et al.

[11] Patent Number: 4,806,045

[45] Date of Patent: Feb. 21, 1989

[54] MOVABLE CURB STRUCTURE AND METHOD OF PROVIDING EASY ACCESS TO A MANHOLE STRUCTURE

[75] Inventors: James M. Pitts, Warrensville Hts.; Richard L. Taus, Sagamore Hills, both of Ohio

[73] Assignee: The Ohio Bell Telephone Company, Cleveland, Ohio

[21] Appl. No.: 207,457

[22] Filed: Jun. 16, 1988

[51] Int. Cl.[4] ..... E01C 11/22; E02D 29/14

[52] U.S. Cl. ..... 404/7; 404/25; 404/72; 52/20

[58] Field of Search ..... 404/2-5, 404/7, 25, 26, 72, 73; 52/19, 20; 249/2, 8

[56] References Cited

U.S. PATENT DOCUMENTS

| | | | |
|---|---|---|---|
| 374,393 | 12/1887 | Campbell | 404/4 |
| 760,841 | 5/1904 | Bedell | 52/21 |
| 1,076,386 | 10/1913 | O'Day | 404/26 |
| 1,408,982 | 3/1922 | Calhoun | 404/26 |
| 2,930,295 | 3/1960 | Hale | 404/26 |
| 3,237,538 | 10/1963 | McPheeters et al. | 404/26 |
| 3,533,199 | 8/1968 | Pickett | 52/20 |
| 4,075,796 | 2/1978 | Cuozzo | 52/20 |
| 4,445,802 | 5/1984 | Lööv | 404/7 X |
| 4,594,157 | 6/1986 | McGowan | 404/4 X |
| 4,637,585 | 1/1987 | Picollo | 404/5 X |
| 4,673,310 | 6/1987 | LeBaron | 404/26 |

*Primary Examiner*—Jerome W. Massie
*Assistant Examiner*—Matthew Smith
*Attorney, Agent, or Firm*—Renner, Otto, Boisselle & Sklar

[57] ABSTRACT

A movable curb structure provides for easy access to a manhole structure wherein a permanent curb structure is substantially in line with the manhole structure by stopping the permanent curb structure on opposite sides of the manhole structure, forming a concrete pad behind and partially around the sides of the manhole structure, and removably mounting a cover box to the concrete pad with a front vertical wall of the cover box substantially in line with a back side of the permanent curb structure, and removably mounting a movable curb section to the front vertical wall of the cover box substantially in line with the permanent curb structure. Where the height of the permanent curb structure is different from the height of the movable curb section, the permanent curb structure is stopped some distance from the ends of the movable curb section so that the permanent curb structure can be blended either up or down to the height of the movable curb section depending on the relative heights of the permanent curb structure and movable curb section by providing tapered curb sections at the ends of the permanent curb structure.

19 Claims, 2 Drawing Sheets

MOVABLE CURB STRUCTURE AND METHOD OF PROVIDING EASY ACCESS TO A MANHOLE STRUCTURE

BACKGROUND OF THE INVENTION

This invention relates generally, as indicated, to a movable curb structure and method for providing easy access to a manhole structure located substantially in line with a new permanent curb structure during a street widening or the like. Such a movable curb structure is primarily intended to be used in road or street widening projects to eliminate the high cost of having to relocate a utility manhole when in the way of the street widening.

Due to cost considerations and other factors, whenever possible, manholes utilized for accessing underground phone lines and other utilities are normally located in the tree lawn in residential or commercial areas. However, oftentimes during a street widening, the new permanent curb is moved back to the location of the manhole structure. Heretofore, this required the manhole structure to be offset or completely rebuilt at a new location where it is out of the way. In either case, this is both costly and time consuming.

SUMMARY OF THE INVENTION

The present invention eliminates the substantial time and expense of having to offset or relocate a manhole structure during a street widening project where the new permanent curb is to be located substantially in line with the manhole, by providing a movable curb structure in overlying relation to the manhole. To that end, the new permanent curb structure is stopped in spaced relation from the opposite sides of the manhole structure, and a concrete pad is poured behind and partially around the opposite sides of the manhole structure. The pad is also poured sufficiently below the ground or grade line such that when a cover box is subsequently mounted on the pad, the upper surface of the cover box is substantially flush with the ground line. Also, the front vertical wall of the cover box is positioned substantially in line with the back side of the new permanent curb to facilitate mounting of a movable curb section to such front wall substantially in line with the new permanent curb structure.

In situations where the height of the new permanent curb structure is greater or less than the height of the movable curb section, the new curb structure is desirably stopped some distance from the ends of the movable curb section so that the new curb structure can be blended either up or down to the height of the movable curb section depending on the relative heights of the new curb structure and movable curb section.

Access to the manhole structure is easily obtained by unbolting the movable curb section from the front wall of the cover box and unbolting the cover box from the pad and raising the cover box. To restore the movable curb structure back to its original state, the process is simply reversed.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
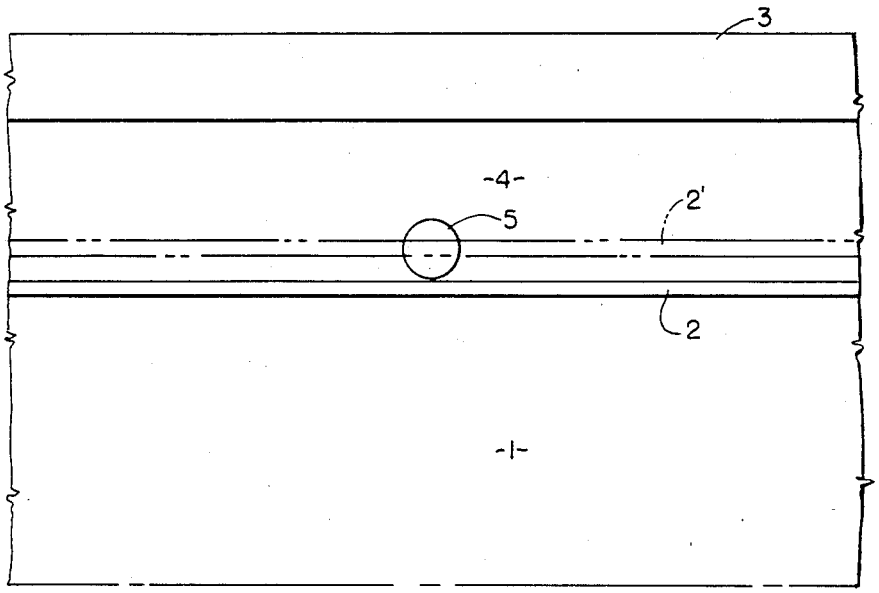
FIG. 1 is a fragmentary schematic top plan view of a portion of a street showing a manhole structure located in a tree lawn between the curb and a sidewalk paralleling the curb and street.

Referring now in detail to the drawings, and initially to FIG. 1, there is schematically shown a portion of a street 1 such as may be found in any residential or commercial area including a permanent curb structure 2 along the sides and a sidewalk 3 paralleling the curb (street). Between the sidewalk 3 and curb 2 is a narrow strip of ground, commonly referred to as a tree lawn 4. Because of cost considerations and other factors, whenever possible, manholes used to access underground phone lines and other utilities are located in the tree lawn. One such manhole structure 5 is schematically shown in FIG. 1.

Should the state, city or other municipality propose a road widening project, the responsible utility would normally be required to move the manhole or other above ground obstruction if in the way of the street widening project. Frequently, during such a street widening, the proposed new permanent curb 2', shown in phantom lines in FIG. 1, will pass directly over the manhole 5. Heretofore, this necessitated either offsetting the manhole structure or rebuilding the manhole to relocate it out of the way. In either case, this was both a costly and time consuming requirement.

Figure 2:
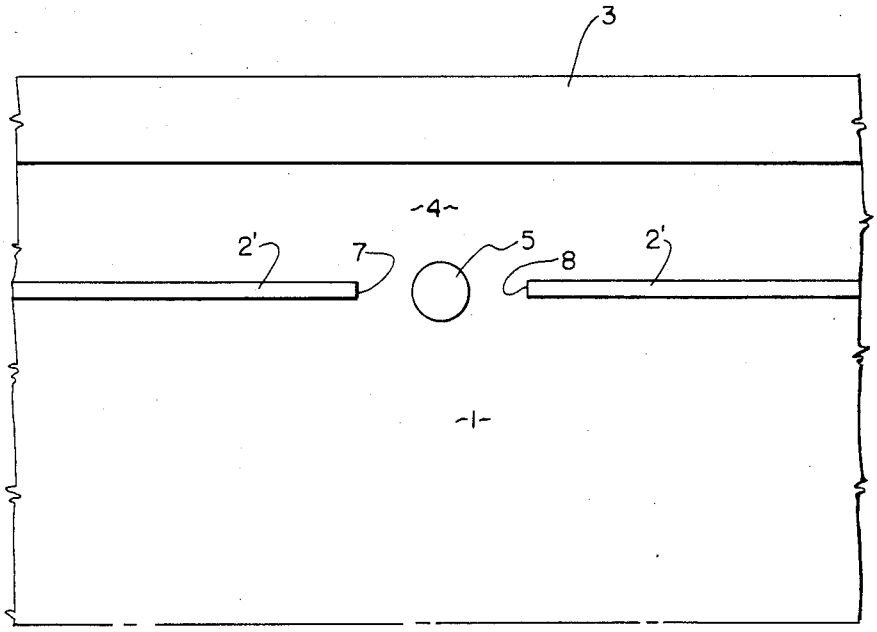
FIG. 2 is a schematic fragmentary top plan view similar to FIG. 1 but showing the old curb removed and a new permanent curb structure substantially in line with the manhole but stopping in spaced relation from opposite sides of the manhole.

The present invention eliminates the need for having to offset or relocate such a manhole structure. Briefly, this is accomplished in accordance with the present invention by stopping the new permanent curb structure 2' some distance from the opposite sides of the manhole structure 5 as schematically shown in FIG. 2 to provide room for the placement of a movable curb structure 6 (see FIGS. 5 and 6) in the space between the spaced apart ends 7, 8 of the new curb structure 2' as described hereafter.

Figure 3:
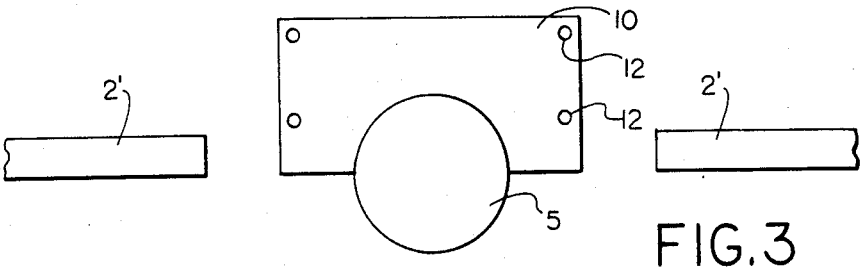
FIG. 3 is an enlarged fragmentary top plan view of the new permanent curb structure and manhole of FIG. 2 but showing a concrete pad formed and poured around the back and portions of the sides of the manhole.
Figure 4:
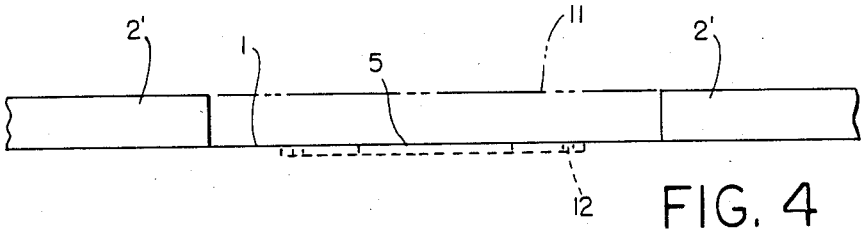
FIG. 4 is a fragmentary front elevation view of the new curb structure and manhole and concrete pad of FIG. 3 showing the location of the concrete pad below the ground line.

To ready the space for the placement of a movable curb structure, a concrete pad 1 is formed and poured in an area both behind and partially around both sides of the manhole structure 5 as schematically shown in FIGS. 3 and 4. The concrete pad 10 is poured below the ground line 11 (i.e. below grade) so that when a cover box is subsequently mounted on the pad, the top of the cover box will be substantially flush with the ground line. Also, both the top of the pad 10 as well as the top of the manhole 5 are desirably substantially flush with the widened street surface at that point so as not to create any undesirable obstructions or depressions. During such pouring of the pad 10, a plurality of threaded inserts 12 are desirably cast in the concrete to facilitate attachment and removal of the cover box to the pad using bolts or the like.

In the embodiment disclosed herein, four such inserts 12 are shown, two along each side of the pad. However, it will be apparent that the number and location of such inserts or other suitable fastener means may be varied as desired.

Figure 5:
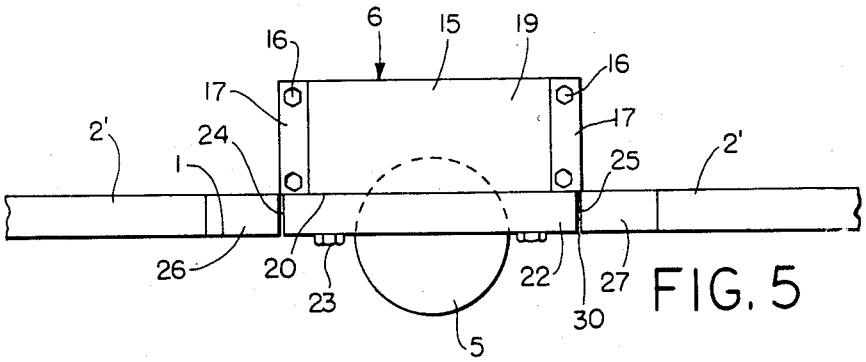
FIG. 5 is an enlarged fragmentary top plan view similar to FIG. 3 but showing a cover box bolted to the concrete pad with its front vertical wall substantially in line with the back side of the new permanent curb structure and a movable curb section bolted to such front wall substantially in line with the new permanent curb structure and the new permanent curb structure blended to the movable curb section.
Figure 6:
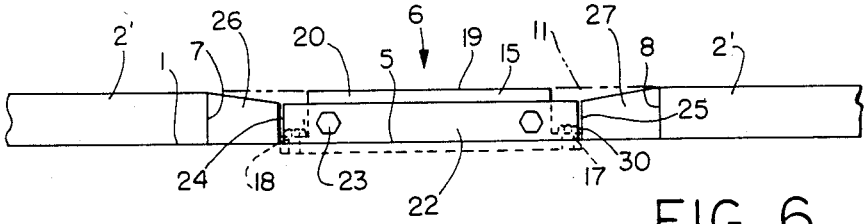
FIG. 6 is a fragmenary front elevation view of the structure of FIG. 5.

After the pad 10 has cured sufficiently, a cover box 15 is mounted to the pad using conventional mounting bolts or other suitable attachment means 16 as schematically shown in FIGS. 5 and 6. Preferably, the cover box 15 has flanges 17 along opposite sides, with holes 18 therethrough in lines with the inserts 12 when the cover box is properly positioned on the pad 10 for insertion of the bolts 16 through the flanges and into the inserts.

The cover box 15 is desirably sized so that the upper surface 19 of the cover box is substantially flush with the ground line 11 when properly installed as schematically shown in FIG. 6. Also the cover box 15 is positioned behind the new permanent curb 2' with the front vertical wall 20 of the cover box substantially in line with the back side of the new curb, to facilitate the mounting of a movable curb section 22 to such front wall substantially in line with the new permanent curb 2' using mounting bolts 23 or the like as schematically shown in FIGS. 5 and 6.

Although the length and height of the movable curb section 22 may be varied as desired, only one size of movable curb section having a length, for example, of approximately forty eight inches and a height of approximately six inches is all that is necessary due to the fact that the movable curb section 22 can be blended in to fit most curbing situations. The new permanent curb 2' will have a height, for example, of anywhere from four to eight inches. In the event that the new permanent curb 2' has a height greater or less than the height of the movable curb section 22, when the new permanent curb 2' is cast, it is stopped some distance from the ends 24,24 of the movable curb section 22, for example, approximately twelve inches from such ends or approximately thirty six inches from the center of the manhole structure 5 where the length of the movable curb section 22 is approximately forty eight inches. This provides sufficient space to blend the ends of the new permanent curb 2' either up or down to the height of the movable curb section 22 depending on the relative sizes of the new and movable curbs. For example, FIG. 6 shows a permanent curb 2' having a height somewhat greater than the movable curb section 22, so the ends of the new permanent curb 2' are blended down to the ends of the movable curb section by adding downwardly tapered curb sections 26,27 at the ends of the new permanent curb 2'. Of course, a small gap 30 should still be left between the ends of the tapered curb sections 26,27 and the adjacent ends of the movable curb section 22 to facilitate insertion and removal of the movable curb section 22 therefrom as required.

To access the manhole structure 5, the movable curb section 22 is simply unbolted from the front wall 20 of the cover box 15 and the cover box is unbolted from the concrete pad 10 and removed therefrom to uncover the manhole structure as schematically shown in FIGS. 3 and 4. To restore the movable curb structure 6 back to its original state, the cover box 15 is once again bolted to the concrete pad 1 and the movable curb section 22 is reattached to the front wall of the cover box 15 as schematically shown in FIGS. 5 and 6.

From the foregoing, it will now be apparent that the movable curb structure of the present invention eliminates the need for having to offset or relocate a manhole structure that is in line with a new permanent curb during a street widening or the like, in that the movable curb structure permits easy access to the manhole structure. Such a movable curb structure is much less costly to install than the cost of offsetting or relocating the manhole structure. Also, only one size of movable curb section can be blended to fit almost any curbing situations.

Although the invention has been shown and described with respect to a certain preferred embodiment, it is obvious that equivalent alternations and modifications will occur to others skilled in the art upon the reading and understanding of the specification. The present invention includes all such equivalent alterations and modifications, and is limited only by the scope of the claims.

What is claimed is:

1. A movable curb structure for providing easy access to a manhole structure wherein a permanent curb structure is substantially in line with the manhole structure but stops on opposite sides of the manhole structure comprising a cover box, first mounting means for removably mounting said cover box in partial overlying relation to said manhole structure with a front vertical wall of said cover box substantially in line with a back side of said permanent curb structure, a movable curb section, and second mounting means for removably mounting said movable curb section to said front vertical wall of said cover box so that said movable curb section is substantially in line with said permanent curb structure.

2. The movable curb structure of claim 1 wherein said cover box includes a top surface which is substantially flush with a ground line behind said permanent curb structure.

3. The movable curb structure of claim 1 further comprising a concrete pad extending behind and partially around the sides of said manhole structure, said first mounting means comprising fastener means for attaching said cover box to said concrete pad.

4. The movable curb structure of claim 3 wherein said cover box has side flanges with holes therein for insertion of said fastener means through said holes.

5. The movable curb structure of claim 4 wherein said concrete pad has inserts therein in line with said holes in said flanges of said cover box when said cover box is properly positioned on said concrete pad for receipt of said fastener means when inserted through said holes.

6. The movable curb structure of claim 5 wherein said inserts are threaded inserts which are cast in said concrete pad during the pouring of said concrete pad behind and partially around said manhole structure.

7. The movable curb structure of claim 6 wherein said fastener means comprises bolts which are threadedly received in said inserts.

8. The movable curb structure of claim 1 wherein said movable curb section has a different height than said permanent curb structure, further comprising tapered curb sections at the ends of said permanent curb structure which blend said permanent curb structure in with said movable curb section.

9. The movable curb structure of claim 8 wherein a gap is left between the adjacent ends of said movable curb section and said tapered curb sections.

10. The movable curb structure of claim 9 wherein said movable curb section has a length of approximately forty eight inches and a height of approximately six inches.

11. The movable curb structure of claim 10 wherein said permanent curb structure has a height of anywhere from approximately four inches to approximately eight inches.

12. The movable curb structure of claim 1 wherein said second mounting means comprises bolt means for bolting said movable curb section directly to said cover box.

13. A method of providing easy access to a manhole structure wherein a permanent curb structure is substantially in line with said manhole structure comprising the steps of stopping said permanent curb structure on opposite sides of said manhole structure, removably mounting a cover box over a portion of said manhole structure with a front vertical wall of said cover box substantially in line with a back side of said permanent curb structure, and removably mounting a movable curb section to said front vertical wall of said cover box substantially in line with said permanent curb structure.

14. The method of claim 13 wherein said cover box includes a top surface which is located substantially flush with a ground line behind said permanent curb structure when said cover box is mounted as aforesaid.

15. The method of claim 13 further comprising the step of forming a concrete pad behind and partially around the sides of said manhole structure for supporting said cover box when mounted as aforesaid.

16. The method of claim 15 wherein said concrete pad has inserts cast therein during the pouring of said pad for threaded receipt of bolts passing through flanges on said cover box for removably mounting said cover box to said pad.

17. The method of claim 13 wherein said movable curb section is of a different height than said permanent curb structure, further comprising the steps of stopping said permanent curb structure some distance from the ends of said movable curb section, and forming tapered curb sections at the ends of said permanent curb structure which blend with the ends of said movable curb section.

18. The method of claim 17 wherein a gap is left between the adjacent ends of said movable curb section and said tapered curb sections during the forming of said tapered curb sections.

19. The method of claim 18 wherein said movable curb section has a length of approximately forty eight inches and a height of approximately six inches, and said tapered curb sections have a length of approximately twelve inches.

* * * * *